US009670728B2

(12) United States Patent
Tang

(10) Patent No.: US 9,670,728 B2
(45) Date of Patent: Jun. 6, 2017

(54) ROTARY IMPACT DRILL AND DOUBLE-LAYER DRILLING ROD MECHANISM

(76) Inventor: Zhongsheng Tang, Nanning (CN)

( * ) Notice: Subject to any disclaimer, the term of this patent is extended or adjusted under 35 U.S.C. 154(b) by 646 days.

(21) Appl. No.: 14/117,668

(22) PCT Filed: Jul. 29, 2011

(86) PCT No.: PCT/CN2011/001241
§ 371 (c)(1),
(2), (4) Date: Nov. 14, 2013

(87) PCT Pub. No.: WO2012/155305
PCT Pub. Date: Nov. 22, 2012

(65) Prior Publication Data

US 2014/0083775 A1 Mar. 27, 2014

(30) Foreign Application Priority Data

May 16, 2011 (CN) ..... 2011 1 0125714
May 16, 2011 (CN) ..... 2011 2 0155177 U

(51) Int. Cl.

| | |
|---|---|
| ***E21B 6/04*** | (2006.01) |
| ***E21B 1/02*** | (2006.01) |
| ***E21B 3/02*** | (2006.01) |
| ***E21B 7/00*** | (2006.01) |
| ***E21B 6/00*** | (2006.01) |

(52) U.S. Cl.
CPC ..... *E21B 6/04* (2013.01); *E21B 1/02* (2013.01); *E21B 3/02* (2013.01); *E21B 6/00* (2013.01); *E21B 7/002* (2013.01)

(58) Field of Classification Search
None
See application file for complete search history.

(56) References Cited

U.S. PATENT DOCUMENTS 3,786,874 A * 1/1974 Jodet ..... E21B 7/24 173/105
4,094,364 A * 6/1978 Lundstrom ..... E21B 6/00 173/126

(Continued)

FOREIGN PATENT DOCUMENTS

| | | |
|---|---|---|
| CN | 2210252 Y | 10/1995 |
| CN | 2654836 Y | 11/2004 |
| CN | 2864065 Y | 1/2007 |

(Continued)

*Primary Examiner* — Caroline Butcher
(74) *Attorney, Agent, or Firm* — Fraser Clemens Martin & Miller LLC; James D. Miller

(57) ABSTRACT

A rotary drill and a double-layer drilling rod mechanism are disclosed. A connecting rod (2) is provided in the rotary connecting sleeve (9), and the rotary connecting sleeve (9) is connected with the double-layer drilling rod mechanism (11). An impact drilling string (25) located by a guide bearing bush (26) is arranged in the outer rotary drilling pipe (28) of the double-layer drilling rod mechanism (11); a latch (24) for connecting the connecting rod (2) is arranged at the top of the inner impact drilling string (25); and an impact head (12) connected with the impact drilling string (25) is arranged in the drilling bit connecting sleeve (29). The drilling bit (13) below the impact head (12) is connected with the drilling bit connecting sleeve (29) by a front connector (30).

3 Claims, 3 Drawing Sheets

(56) References Cited

U.S. PATENT DOCUMENTS

| | | | | |
|---|---|---|---|---|
| 5,332,048 | A * | 7/1994 | Underwood | E21B 44/005 175/26 |
| 2011/0031020 | A1* | 2/2011 | Cote | E21B 4/10 175/56 |

FOREIGN PATENT DOCUMENTS

| | | | |
|---|---|---|---|
| CN | 201141280 | Y | 10/2008 |
| CN | 101906936 | A | 12/2010 |
| CN | 201826836 | U | 5/2011 |
| DE | 19732479 | C1 | 4/1999 |
| JP | 2680433 | B2 | 11/1997 |
| JP | 2958473 | B2 | 10/1999 |
| JP | 2001-098868 | A | 4/2001 |
| JP | 2002188385 | A | 7/2002 |
| JP | 3127307 | U | 11/2006 |

* cited by examiner

ROTARY IMPACT DRILL AND DOUBLE-LAYER DRILLING ROD MECHANISM

TECHNICAL FIELD OF THE INVENTION

The disclosure relates to the technical field of engineering machinery and mining machinery, in particular to a rotary impact drill for generating impact wave pulse in the direction of a drilling tool.

BACKGROUND OF THE INVENTION

The drill is a piece of mechanical equipment for drilling rock, mainly including a pneumatic down-the-hole drilling machine and a top impact hydraulic drill in the market now. The pneumatic down-the-hole drilling machine, with an impact mechanism down-the-hole hammer at the bottom, can transmit impact energy well and is simple in structure, simple and convenient to operate, straight in drilling and the like, but high in energy consumption, low in rock drilling speed and quick to be worn. The hydraulic drill, with the impact mechanism on the top, transmits impact energy by striking a drilling rod and gradually replaces the pneumatic and electrical drills due to its high energy utilization rate, high rock drilling speed, low environment pollution and easy automation. Therefore, the hydraulic rock drilling technology has been well popularized and applied in the fields, such as mine, hydropower and tunnel traffic. In a conventional hydraulic drill, the impact wave pulse is generated by an impact piston, specifically, the impact piston strikes a shank to transmit the impact wave to the drilling rod, and the drilling rod further transmits the impact wave to a drilling bit. Since the impact energy thereof is transmitted by striking the drilling rod, the impact energy transmitted to the drilling bit will be weakened with the lengthening of the drilling rod, so that the drilling hole is easy to deflect, the drilling precision is low and so on. In addition, the working principle of the conventional hydraulic drill is to make the impact piston move to and fro at a high speed in a cylinder to generate impact energy by hydraulic differential pressure. Under the limitation of a hydraulic component, the hydraulic drill is limited in impact energy, thereby being not ideal in rock drilling operation of the large diameter drilling hole and deep hole, as shown in the Chinese invention named "rock drilling method and drill" with the application number of 200780041358, and the Chinese invention named "impact device and drill including the same" with the application number of 200780002786. In addition, some top impact hydraulic drills adopt a double-layer casing to reduce the deflection degree of the drilling hole, such as Coprod of Atlas Copco, and it only improves the top impact drill rather than improving the effect substantially.

SUMMARY OF THE INVENTION

The technical problem to be solved by the disclosure is to provide a rotary impact drill and a double-layer drilling rod mechanism thereof, which have the high efficiency of the hydraulic drill and the advantages of good transmission of impact energy and straight drilling of the down-the-hole drilling machine, and are easy to generate high impact energy and can implement a large diameter drilling hole and a deep hole rock drilling.

The technical problem is solved by the following technical scheme in the disclosure:

According to the first inventive point, a rotary impact drill comprises a vibration excitation mechanism consisting of a hydraulic motor, an excitation box, an eccentric shaft, a gear and an eccentric block, wherein a rotating mechanism is mounted at the bottom of the vibration excitation mechanism by a guide rod with a spring; a flushing mechanism is mounted at the bottom of the rotating mechanism; wherein the rotating mechanism consists of a rotary box, and a driving gear, a rotary gear and a rotary connecting sleeve which are mounted in the rotary box; the rotary gear is tightly cased on the rotary connecting sleeve and is engaged with the driving gear; a connecting rod provided at the bottom of the excitation box is arranged in the rotary connecting sleeve, and the rotary connecting sleeve is connected with a double-layer drilling rod mechanism after passing through the flushing mechanism; the double-layer drilling rod mechanism comprises an outer rotary drilling pipe and an inner impact drilling string, wherein the inner impact drilling string is located in the outer rotary drilling pipe by a guide bearing bush; a latch for connecting the connecting rod is arranged at the top of the inner impact drilling string; a drilling bit connecting sleeve is connected with the bottom of the double-layer drilling rod mechanism, and an impact head connected with the inner impact drilling string is arranged in the drilling bit connecting sleeve (29); and a drilling bit below the impact head is connected with the drilling bit connecting sleeve by a front connector.

The double-layer drilling rod mechanism consists of the outer rotary drilling pipe and the inner impact drilling string; the outer rotary drilling pipe thereof is in threaded connection with the drilling bit connecting sleeve; a plurality of the double-layer drilling rod mechanisms are provided correspondingly; the outer rotary drilling pipes are in threaded connection with each other, and the inner impact drilling strings are connected with each other by the latches; a guide bearing bush, a lock bar lug and a return spring are arranged between the inner impact drilling string and the outer rotary drilling pipe; the lock bar lug is tightly cased on the inner impact drilling string, and the return spring is arranged between the lock bar lug and the guide bearing bush to keep the impact drilling string in the original place when the outer rotary drilling pipe is separated.

The vibration excitation mechanism adopts an eccentric vibration mechanism consisting of the eccentric shaft and the eccentric block in pairs.

The impact head is provided with the latch and is connected with the inner impact drilling string of the double-layer drilling rod mechanism by the latch.

According to the second inventive point, a double-layer drilling rod mechanism mainly comprises an outer rotary drilling pipe and an inner impact drilling string, wherein the inner impact drilling string is located in the outer rotary drilling pipe by a guide bearing bush; the two ends of the outer rotary drilling pipe and the inner impact drilling string are provided with connectors for connecting other mechanisms; and the inner impact drilling string is capable of moving repetitively for a certain distance in the outer rotary drilling pipe.

In this disclosure, the inner impact drilling string of the double-layer drilling rod mechanism is driven by the vibration excitation mechanism to move repetitively. Since the impact head located at the bottom of the double-layer drilling rod mechanism is driven by the impact drilling string to impact the drilling bit directly to generate impact energy, the impact energy on the drilling bit is not weakened with the lengthening of the drilling rod. Therefore, the disclosure has the high efficiency of the hydraulic drill and the advantages of good transmission of impact energy and straight drilling of the down-the-hole drilling machine; and furthermore, high impact energy is easy to generate and large-diameter drilling and deep hole rock drilling are implemented.

Figure 1:
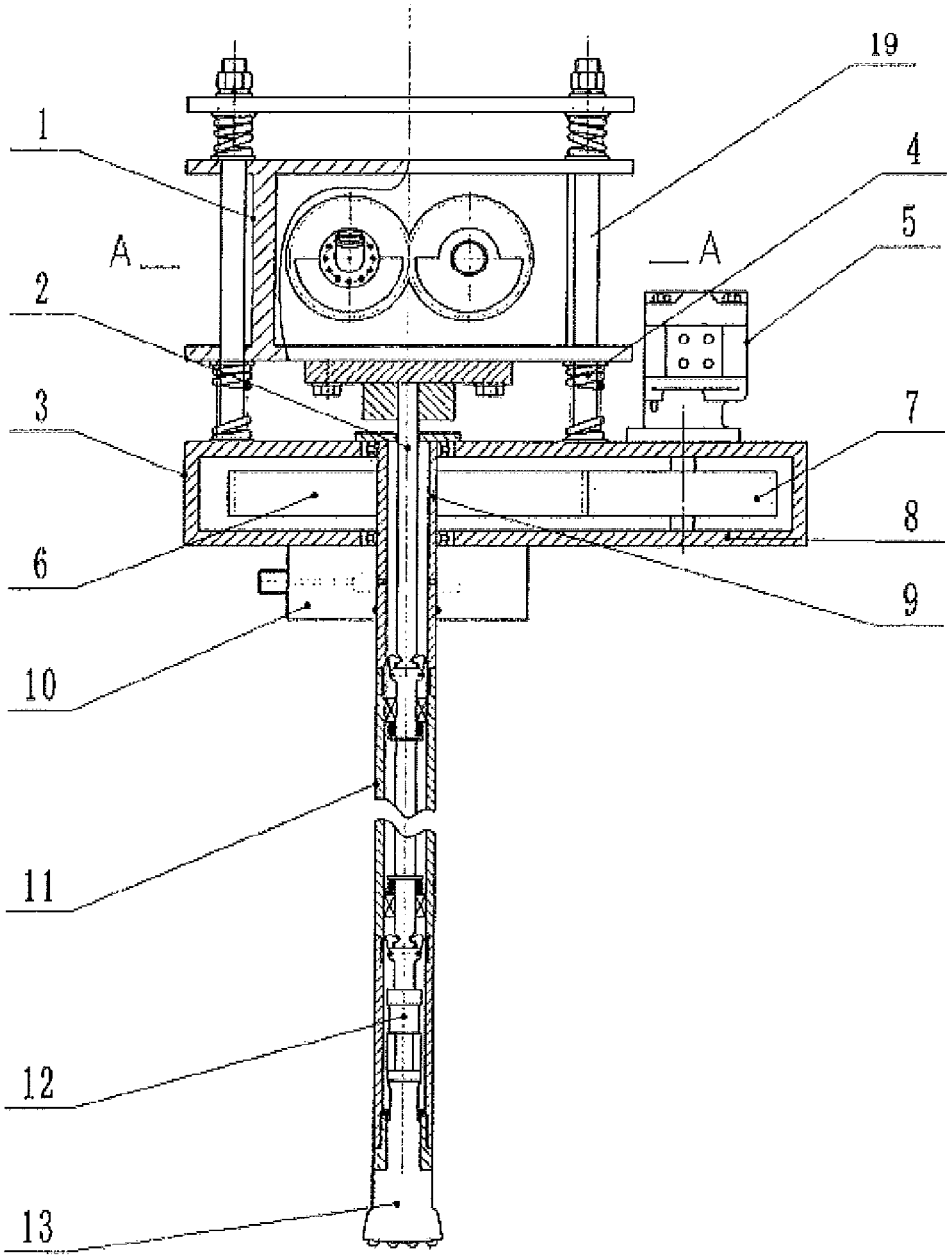
FIG. 1 is a diagram showing the structure of a rotary impact drill of the disclosure.
Figure 2:
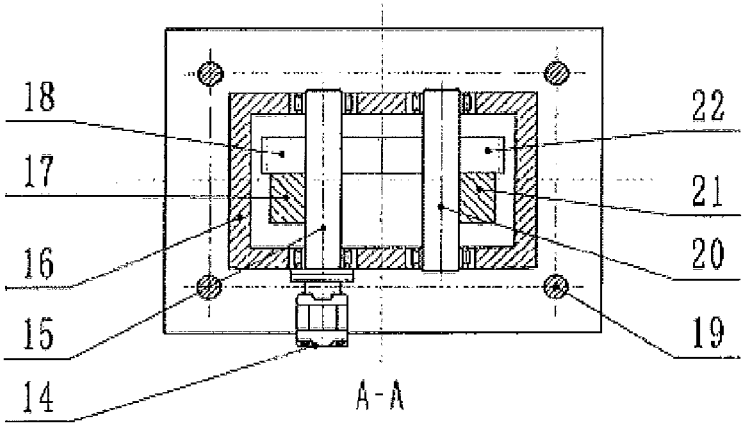
FIG. 2 is a diagram showing the A-A section in FIG. 1.
Figure 3:
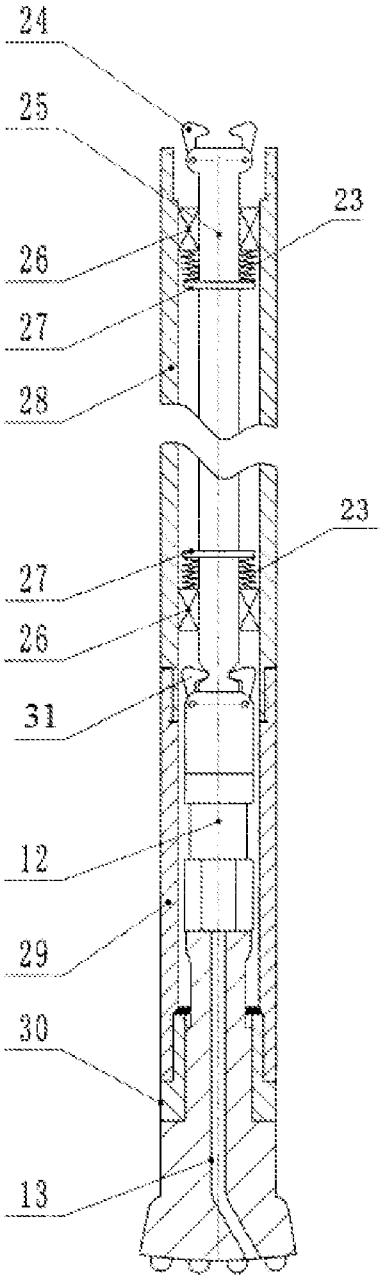
FIG. 3 is an enlarged diagram showing the connection between a double-layer drilling rod mechanism and a drilling bit in FIG. 1.

In the drawings: vibration excitation mechanism 1, connecting rod 2, rotating mechanism 3, spring 4, second hydraulic motor 5, rotary gear 6, driving gear 7, rotary box 8, rotary connecting sleeve 9, flushing mechanism 10, double-layer drilling rod mechanism 11, impact head 12, drilling bit 13, first hydraulic motor 14, first driving eccentric shaft 15, excitation box 16, first eccentric block 17, first driving gear 18, guide rod 19, second eccentric shaft 20, second eccentric block 21, first driven gear 22, return spring 23, first latch 24, inner impact drilling string 25, guide bearing bush 26, lock bar lug 27, outer rotary drilling pipe 28, drilling hit connecting sleeve 29, front connector 30, and latch 31.

DETAILED DESCRIPTION OF THE EMBODIMENTS

The disclosure is further described below with reference to the drawings.

The vibration excitation mechanism 1 adopted in the disclosure could adopt the impact mechanism referred in the Chinese invention named "an impact hydraulic drill" with the application number of 201010596120.4. The vibration excitation mechanism 1 adopted in this embodiment includes a first hydraulic motor 14, an excitation box 16, a first driving eccentric shaft 15, a first driving gear 18, a first driven gear 22, a first eccentric block 17, a second eccentric block 21, a second eccentric shaft 20 and a connecting rod 2, further may be provided with two, four or more eccentric shafts and eccentric blocks in pairs as required. Two same eccentric shafts in the vibration excitation mechanism are arranged side by side on the excitation box to form an eccentric group; the eccentric shafts are provided with the same eccentric block and gear; the first driving gear 18 in the eccentric group is engaged with the first driven gear 22; the first driving eccentric shaft 15 in the eccentric group is connected with the first hydraulic motor 14; and the connecting rod 2 is mounted at the bottom of the excitation box 16 and is connected with an inner impact drilling string 25 of the double-layer driving rod mechanism 11 by a first latch 24.

The rotating mechanism 3 is mounted at the bottom of the vibration excitation mechanism 1 by four or more guide rods 19 which are arranged symmetrically and provided with springs 4. The rotating mechanism 3 consists of a rotary box 8 and a driving gear 7, a rotary gear 6 and a rotary connecting sleeve 9 in the rotary box 8. The rotary gear 6 is tightly cased on the rotary connecting sleeve 9. The gear shaft of the driving gear 7 engaged with the rotary gear 6 is connected with the second hydraulic motor 5; and the connecting rod 2 mounted at the bottom of the excitation box 16 is provided in the rotary connecting sleeve 9.

The flushing mechanism 10 is mounted at the bottom of the rotating mechanism 3; and the rotary connecting sleeve 9 is in threaded connection with an outer rotary drilling pipe 28 of the double-layer drilling rod mechanism 11 after passing through the flushing mechanism 10.

The double-layer drilling rod mechanism 11 consists of the outer rotary drilling pipe 28 and the inner impact drilling string 25, wherein the first latch 24 for connecting the connecting rod 2 is arranged at the top of the inner impact drilling string 25; a drilling bit connecting sleeve 29 is located at the bottom thereof and is in threaded connection with the outer rotary drilling pipe 28 of the double-layer drilling rod mechanism 11; a plurality of double-layer drilling rod mechanisms 11 may be provided correspondingly, the threaded connection is adopted among the outer rotary drilling pipes 28, and the inner impact drilling strings 25 are connected by second latches. A guide bearing bush 26, a lock bar lug 27 and a return spring 23 are arranged between the inner impact drilling string 25 and the outer rotary drilling pipe 28. The lock bar lug 27 is tightly cased on the inner impact drilling string 25; and the return spring 23 is arranged between the lock bar lug 27 and the guide bearing bush 26 to keep the impact drilling string in the original place when the outer rotary drilling pipe is separated.

The double-layer drilling rod mechanism 11 can also be applied to other fields. Its inner impact drilling string 25 is located in the outer rotary drilling pipe 28 by the guide bearing bush 26; the two ends of the outer rotary drilling pipe 28 and the inner impact drilling string 25 are provided with connectors for connecting other mechanisms; and the inner impact drilling string 25 could move repetitively for a certain distance in the outer rotary drilling pipe 28.

The impact head 12 which is placed in the drilling bit connecting sleeve 29 is connected with the bottom of the inner impact drilling string 25 of the double-layer drilling rod mechanism 11 by a latch 31 and directly impacts on the drilling bit 13. The drilling bit 13 below the impact head 12 is connected with the drilling bit connecting sleeve 29 by the front connector 30.

The inner impact drilling string 25 is located by the guide bearing bush 26 provided in the groove of the outer rotary drilling pipe 28, and the inner impact drilling string 25 is provided with the lock bar lug 27 and the return spring 23 to keep the impact drilling string 25 in the original place when the outer rotary drilling pipe 28 is separated.

During the normal operation, the first hydraulic motor 14 drives the first driving eccentric shaft 15 to rotate so as to drive the first driving gear 18 to rotate at the same time, the first driven gear 22 engaged with the first driving gear 18 also rotates with the first driving gear 18 to drive the second driven eccentric shaft 20 to rotate synchronously and reversely, so that the first eccentric block 17 and the second eccentric block 21 rotate synchronously and reversely, the components of the centrifugal force generated by rotating the two eccentric blocks in the central line directions of two eccentric shafts are neutralized at the same time, while the components in the directions vertical to the central lines of two eccentric shafts are overlaid to form an excitation force. The frequency and magnitude of the excitation force can be regulated by controlling the rotating speed of the first hydraulic motor 14.

The excitation box 16 can move repetitively on the guide rod 19 under the action of the excitation force to generate pulse vibration, and the excitation box 16 drives the inner impact drilling string 25 to move repetitively together by the connecting rod 2. The inner impact drilling string 25 drives the impact head 12 at the bottom to move repetitively at a high speed, and the impact head 12 directly impacts the drilling bit 13 to generate impact energy to the drilling bit 13. The outer rotary drilling pipe 28 only transmits rotation torque, and the inner impact drilling string 25 does not rotate but can move repetitively for a certain distance relatively to the outer rotary drilling pipe in the direction parallel to the outer rotary drilling pipe 28.

The second hydraulic motor 5 drives the driving gear 7 in the rotary box 8 to rotate so as to drive the rotary gear 6 engaged therewith to rotate at the same time; the rotary gear 6 is tightly cased on the rotary connecting sleeve 9, which is connected with the outer rotary drilling pipe 28 of the double-layer drilling rod mechanism 11, so as to drive the outer rotary drilling pipe 28 to rotate; and the outer rotary drilling pipe 28 is connected with the drilling bit connecting sleeve 29 and the front connector 30 so as to drive the drilling bit 13 to rotate. As required, dual hydraulic motors for driving can also be adopted to increase the torque.

The flushing mechanism 12 is connected with high-pressure air or high-pressure water, and the high-pressure air or high-pressure water is introduced into the air port of the rotary connecting sleeve 9, then passes through the gap between the inner impact drilling string 25 and outer rotating drilling pipe 28 of the double-layer drilling rod mechanism 11, and then passes through the hole on the impact head 12, and then is sprayed out from the drilling bit 13 to flush the rock fine generated after rock drilling.

The number of the eccentric group of the vibration excitation mechanism adopted in the disclosure is not limited to one and may be two or more. Or multiple layers or rows of eccentric groups can be adopted.

To make the excitation box not easy to deflect in the vibration process, more than four guide rods may be symmetrically arranged and the tops of each guide rod could be connected with each other by top plates.

To meet the requirement to drill rock deeper and deeper, the number of the outer rotary drilling pipes 28 and the inner impact drilling strings 25 could be increased correspondingly. The outer rotary drilling pipes 28 could be in threaded connection or connected in other ways. The connecting ways between the inner impact drilling strings 25 and the connecting rod 2 and the impact head 12 are not only limited to snap joint, and the connecting way between rod impact drilling string and the last rod impact drilling string when connecting a plurality of impact drilling strings is not only limited to snap joint, The way, as long as it can connect both of them for movement together, is feasible and is within the scope of protection of the disclosure.

The special double-layer drilling rod mechanism in the disclosure ensures that the impact energy can be transmitted to the drilling bit without striking the drilling string, which acts similarly to the impact piston and directly drives the impact head to generate impact wave on the drilling bit, so that the bottom impact rock drilling is implemented, which is essentially different from the conventional top impact hydraulic drill. In addition, not like the conventional art where the hydraulic differential pressure is adopted to force the impact piston moving repetitively at a high speed in the cylinder in order to generate impact wave, the device for generating vibration pulse of the disclosure adopts the vibration principle of the eccentric wheel to generate the impact energy, so that the impact energy can be enlarged easily as required and is further easy to be adjusted.

The rotary impact drill can adopt a full hydraulic driving way and has the advantages of high efficiency and low energy consumption. It can also adopt a motor driving as required.

The disclosure is not limited to the implementation way above and various improvements and modifications can be further made on the principle of the disclosure and shall also be regarded as the scope of protection of the disclosure.

What is claimed is:

1. A rotary impact drill, comprising a vibration excitation mechanism (1) consisting of a hydraulic motor, an excitation box, an eccentric shaft, a gear and an eccentric block, wherein a rotating mechanism (3) is mounted at the bottom of the vibration excitation mechanism (1) by a guide rod (19) with a spring (4); a flushing mechanism (10) is mounted at the bottom of the rotating mechanism (3); wherein the rotating mechanism (3) consists of a rotary box (8), and a driving gear (7), a rotary gear (6) and a rotary connecting sleeve (9) which are mounted in the rotary box; the rotary gear (6) is tightly cased on the rotary connecting sleeve (9) and is engaged with the driving gear (7); a connecting rod (2) connected directly to the bottom of the excitation box (16) is arranged in the rotary connecting sleeve (9), and the rotary connecting sleeve (9) is connected with a double-layer drilling rod mechanism (11) after passing through the flushing mechanism (10); the double-layer drilling rod mechanism (11) comprises an outer rotary drilling pipe (28) and an inner impact drilling string (25), wherein the inner impact drilling string (25) is located in the outer rotary drilling pipe (28) by a guide bearing bush (26); a first latch (24) for connecting the connecting rod (2) is arranged at the top of the inner impact drilling string (25); a drilling bit connecting sleeve (29) is connected with the bottom of the double-layer drilling rod mechanism (11), and an impact head (12) connected with the inner impact drilling string (25) is arranged in the drilling bit connecting sleeve (29); and a drilling bit (13) below the impact head (12) is connected with the drilling bit connecting sleeve (29) by a front connector (30); wherein the double-layer drilling rod mechanism (11) consists of the outer rotary drilling pipe (28) and the inner impact drilling string (25); the outer rotary drilling pipe (28) thereof is in threaded connection with the drilling bit connecting sleeve (29); a plurality of the double-layer drilling rod mechanisms are provided correspondingly; the outer rotary drilling pipes (28) are in threaded connection with each other, and the inner impact drilling strings (25) are connected with each other by second latches; the guide bearing bush (26), a lock bar lug (27) and a return spring (23) are arranged between the inner impact drilling string (25) and the outer rotary drilling pipe (28); the lock bar lug (27) is tightly cased on the inner impact drilling string (25), and the return spring (23) is arranged between the lock bar lug (27) and the guide bearing bush (26).

2. The rotary impact drill according to claim 1, wherein the vibration excitation mechanism (1) adopts an eccentric vibration mechanism consisting of the eccentric shaft and the eccentric block in pairs.

3. The rotary impact drill according to claim 1, wherein the impact head (12) is provided with a latch (31) and is connected with the inner impact drilling string (25) of the double-layer drilling rod mechanism (11) by the latch (31) of the impact head (12).

* * * * *